US008232495B2

(12) United States Patent
Tang

(10) Patent No.: US 8,232,495 B2
(45) Date of Patent: Jul. 31, 2012

(54) POWER BUTTON ASSEMBLY AND ELECTRONIC DEVICE USING THE SAME

(75) Inventor: Zi-Ming Tang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 263 days.

(21) Appl. No.: 12/701,660

(22) Filed: Feb. 8, 2010

(65) Prior Publication Data

US 2011/0114464 A1 May 19, 2011

(30) Foreign Application Priority Data

Nov. 18, 2009 (CN) ..... 2009 1 0309949

(51) Int. Cl.
*H01H 13/14* (2006.01)

(52) U.S. Cl. ..... 200/534; 200/520; 200/516

(58) Field of Classification Search ..... 200/406, 200/512–514, 516, 345
See application file for complete search history.

(56) References Cited

U.S. PATENT DOCUMENTS

| | | | | |
|---|---|---|---|---|
| 4,468,542 | A * | 8/1984 | Pounds | 200/5 A |
| 4,476,355 | A * | 10/1984 | Mital | 200/5 A |
| 4,703,139 | A * | 10/1987 | Dunlap | 200/516 |
| 6,310,308 | B1 * | 10/2001 | Watson et al. | 200/520 |
| 7,151,236 | B2 * | 12/2006 | Ducruet et al. | 200/406 |
| 7,414,205 | B1 * | 8/2008 | Heinrich et al. | 200/4 |
| 7,449,654 | B2 * | 11/2008 | Tsuduki | 200/406 |
| 7,547,858 | B2 * | 6/2009 | Nagata | 200/520 |
| 7,705,259 | B2 * | 4/2010 | Kenmochi | 200/514 |
| 7,829,812 | B2 * | 11/2010 | Tolbert et al. | 200/5 A |
| 2007/0158173 | A1 * | 7/2007 | Barnado | 200/512 |
| 2008/0073186 | A1 * | 3/2008 | Kenmochi | 200/5 A |
| 2008/0105527 | A1 * | 5/2008 | Leftly | 200/530 |
| 2008/0237020 | A1 * | 10/2008 | Hu et al. | 200/516 |
| 2008/0277257 | A1 * | 11/2008 | Huang et al. | 200/345 |

* cited by examiner

*Primary Examiner* — Briggitte R Hammond
(74) *Attorney, Agent, or Firm* — Altis Law Group, Inc.

(57) ABSTRACT

A power button assembly includes a printed circuit board having terminals and a dome for trigging the terminals, a support base fixed on the printed circuit board, and a push button positioned between the printed circuit board and the support base. The push button is capable of moving along a first axis relative to the support base. One of the push button and the support base includes a guiding groove, and the other includes a guiding element slidably received in the guiding groove.

14 Claims, 4 Drawing Sheets

POWER BUTTON ASSEMBLY AND ELECTRONIC DEVICE USING THE SAME

CROSS-REFERENCE TO RELATED APPLICATION

This application is related to three co-pending U.S. patent applications, Ser. No. 12/641,611, file on Dec. 18, 2009, and entitled "POWER BUTTON ASSEMBLY AND ELECTRONIC DEVICE USING THE SAME", Ser. No. 12/646,852, file on Dec. 23, 2009, and entitled "POWER BUTTON ASSEMBLY AND ELECTRONIC DEVICE USING THE SAME", and Ser. No. 12/644,363, file on Dec. 22, 2009, and entitled "POWER SWITCH MODULE AND ELECTRONIC DEVICE USING THE SAME". The inventor of all of the three co-pending applications is Bin Dai. The co-pending applications have the same assignee as the present application. The Specification and Drawings of the co-pending applications are incorporated herein by reference.

BACKGROUND

1. Technical Field

The present disclosure relates to a power button assembly and an electronic device using the power button assembly.

2. Description of the Related Art

An electronic device is often provided with a power button assembly to turn a power supply on or off. A commonly used power button assembly includes a plurality of components such as a printed circuit board (PCB), a support base, a push button, and an elastic member positioned between the push button and the PCB to generate a sufficient elastic force to bias the push button. The push button may be received in an assembly hole defined in a housing of the electronic device. The PCB may seat the support base. During assembly, the elastic member and the push button require manual positioning, which is difficult to accurately achieve. Over time, the elastic member may loosen and supply lesser stable elastic force to bias the push button, thus the operation of the power button assembly becomes more difficult.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views.

DETAILED DESCRIPTION

Figure 1:
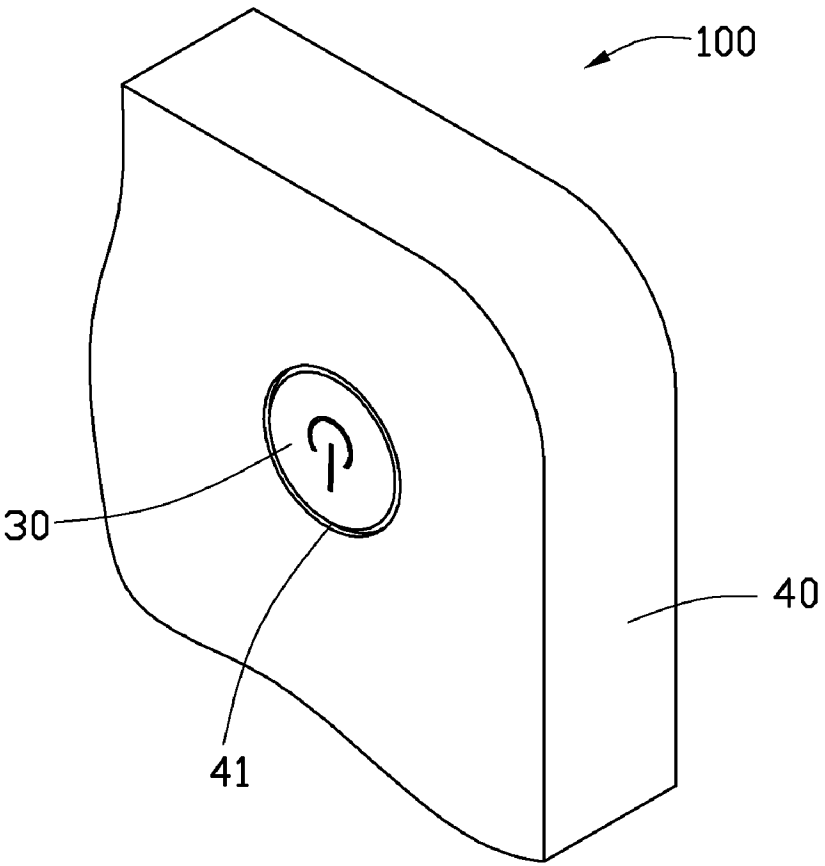
FIG. 1 is a partial, perspective view of an exemplary embodiment of an electronic device, the electronic device including an exemplary embodiment of a power button assembly, also as disclosed.
Figure 2:
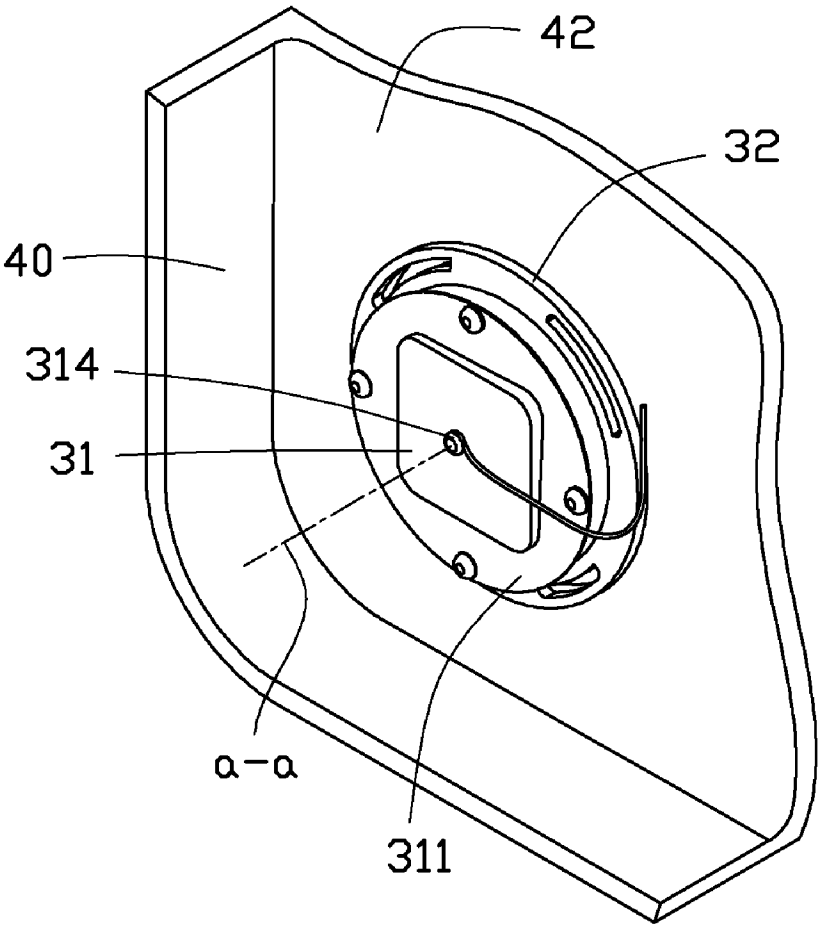
FIG. 2 is similar to FIG. 1, but viewed from another perspective.

Referring to FIGS. 1 and 2, an exemplary embodiment of an electronic device 100 includes a power button assembly 30 and a housing 40. The electronic device 100 may be a notebook, a desktop computer, a liquid crystal display or other electronic device employing the power button assembly 30.

Figure 3:
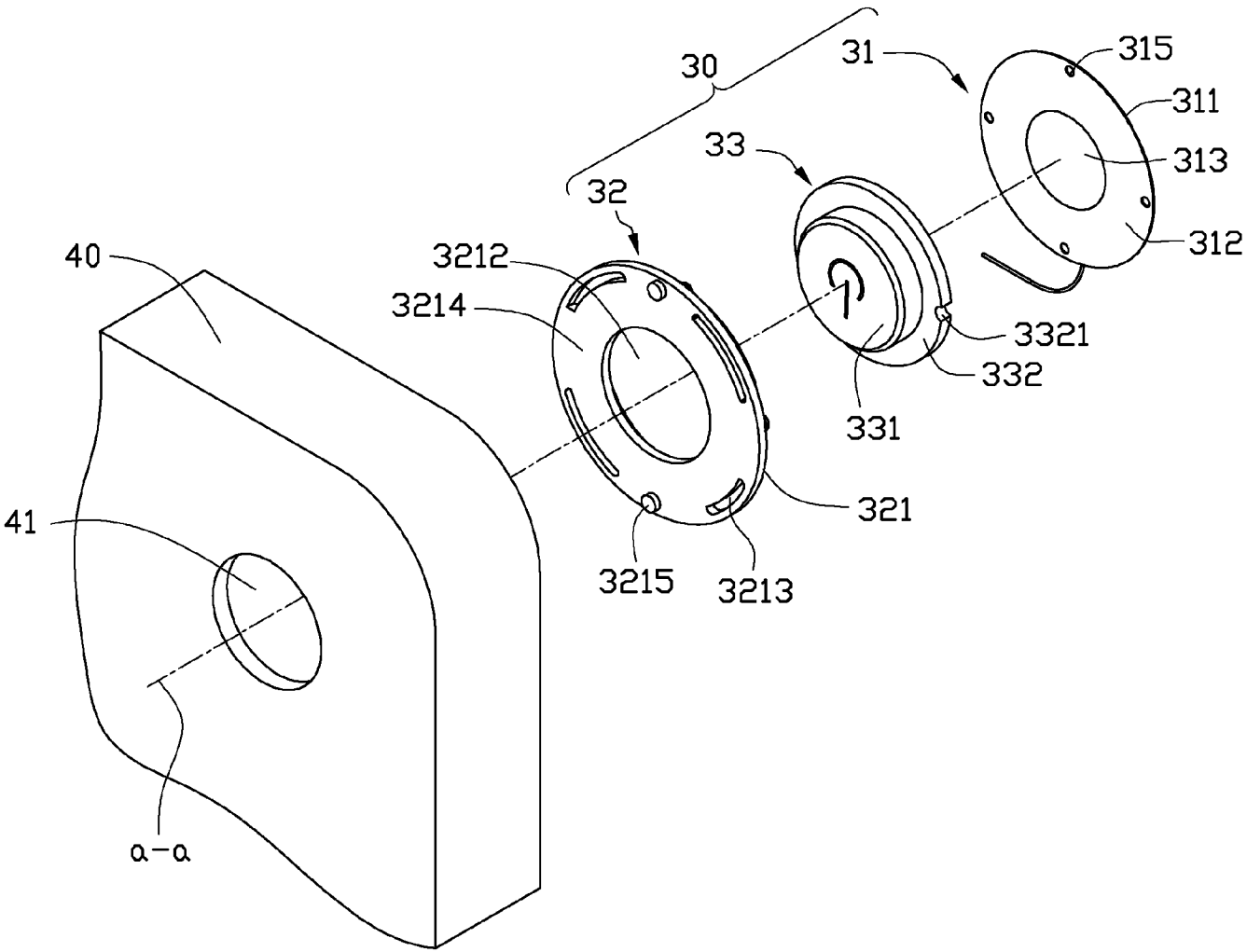
FIG. 3 is an exploded, isometric view of the electronic device of FIG. 1.
Figure 4:
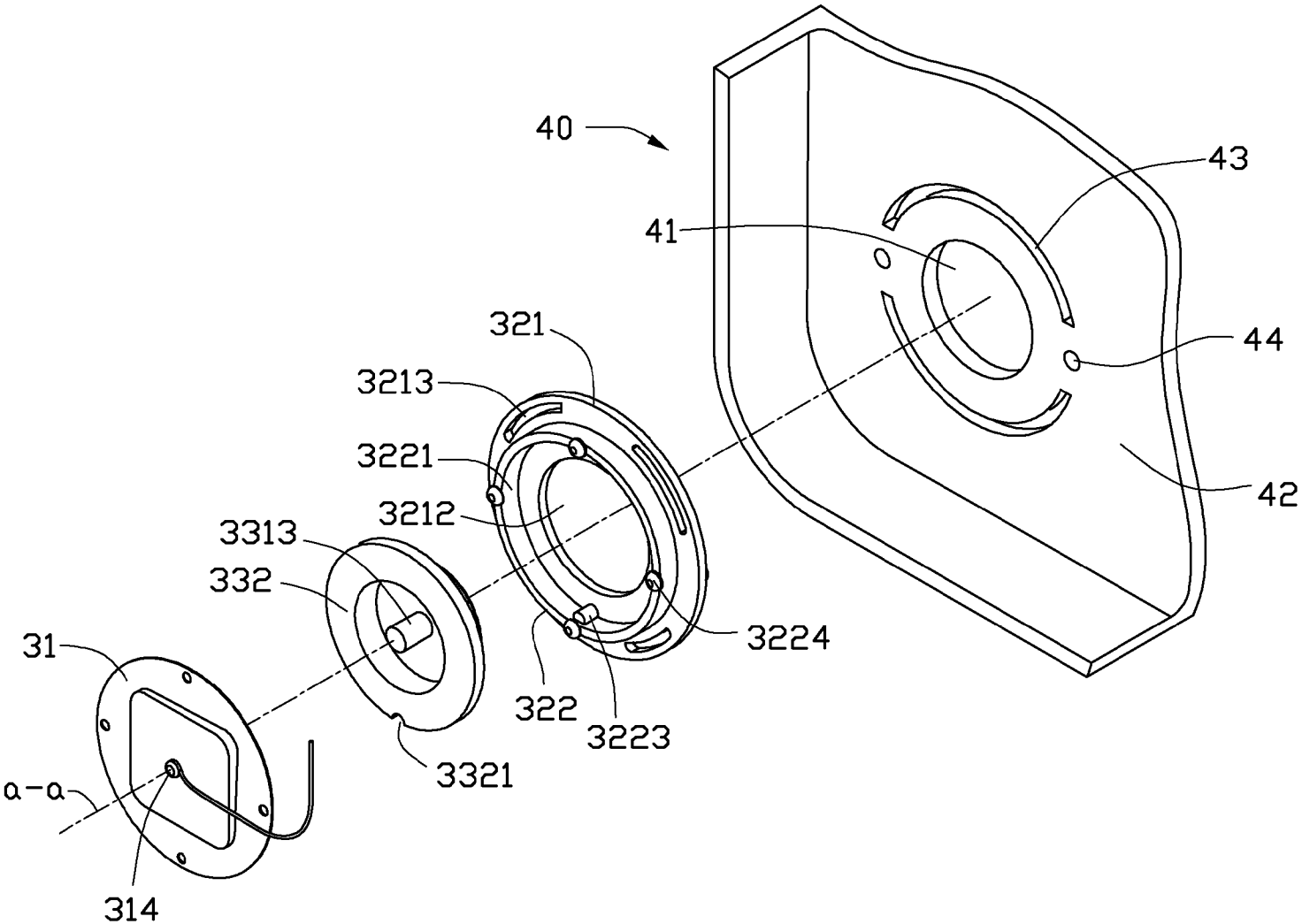
FIG. 4 is similar to FIG. 3, but viewed from another perspective.

Referring also to FIGS. 3 and 4, the power button assembly 30 includes a printed circuit board 31, a support base 32 seated on the printed circuit board 31, and a push button 33 positioned between the support base 32 and the printed circuit board 31. The push button 33 is capable of sliding relative to the support base 32 along a first axis a-a.

The printed circuit board 31 includes a first surface 311 and a second surface 312 opposite to the first surface 311. A dome 313 is formed on the second surface 312 for resiliently abutting the push button 33. The dome 313 may be hemispherical. Terminals 314 (shown schematically) are positioned on the first surface 311. The dome 313 is adjacent to the terminals 314, such that when the dome 313 is depressed towards the terminals 314, the terminals 314 are triggered, thus turning the power supply on or off. In addition, the printed circuit board 31 defines a plurality of assembly holes 315 in the edge region thereof.

The support base 32 includes a base plate 321 and a sleeve 322 integrally formed on the base plate 321. The base plate 321 is a substantially annular sheet defining a through hole 3212 in a center region thereof. The base plate 321 defines a plurality of through slots 3213 arranged around the through hole 3212. The sleeve 322 is substantially cylindrical having a longitudinal axis coaxial with the center of the through hole 3212. The through slots 3213 may be arranged around the sleeve 322 and act as channels allowing adhesive to pass through, thus adhering the base plate 321 to the housing 40. A plurality of posts 3224 is formed on a surface of the sleeve 322 away from the base plate 321, corresponding to the assembly holes 315, respectively. Each post 3224 is fixed to one corresponding assembly hole 315 on the printed circuit board 31 by hot-melting connection, thus facilitating the connection of the printed circuit board 31 and the support base 32. A plurality of locking portions 3215 is formed on a surface opposite to the sleeve 322.

The push button 33 includes a cap 331 and a connecting portion 332 extending radially from the bottom edge of the cap 331. A contact portion 3313 is formed on the cap 331, and can be pushed towards the dome 313 to trigger the terminals 314. The contact portion 3313 may be substantially cylindrical extending along a center axis of the cap 331. The contact portion 3313 has a predetermined length to contact the dome 313.

The sleeve 322 has an inner circumferential surface 3221. A guiding element 3223 is formed on the surface 3221 and extends along the first axis a-a. The guiding element 3223 may be a semi-cylindrical protrusion. The connecting portion 332 has an outer circumferential surface (not labeled) on which a guiding groove 3321 is formed corresponding to the guiding element 3223. The guiding groove 3321 may be a slot. When the push button 33 moves along the first axis a-a relative to the support base 32, the motion of the push button 33 can be guided and the rotation of the push button 33 relative to the support base 32 can be prevented by the guiding element 3223 being received in the guiding groove 3321.

The housing 40 defines an assembly hole 41 in a center region thereof. A plurality of blind slots 43 are defined on the surface of the housing 40 facing the support base 32. The blind slots 43 and the slots 3213 of the base plate 321 cooperatively define a plurality of receiving cavities (not labeled) for receiving adhesive. The housing 40 defines a plurality of locking holes 44 to receive the locking portions 3215 of the support base 32.

During assembly of the power button assembly 30, the push button 33 is sleeved in the sleeve 322 of the support base 32 with the guiding element 3223 slidably received in the guiding groove 3321 and the cap 331 extending into the through hole 3212 of the base plate 321. Therefore, it is simple to position the push button 33 and the support base 32 because the guiding element 3223 slidably engages with the guiding groove 3321. The posts 3224 are received in the assembly holes 315 and fixed therein by means of hot-melt connection, the push button 33 is positioned between the printed circuit board 31 and the support base 32, and the contact portion 3313 resiliently abuts the dome 313, such that the push button 33 stably maintains the current position by elastic force generated by the dome 313. Since the dome 313 can generate a resilient force to return the push button to its original position when an external force thereon is removed, another elastic member can be omitted and the power button assembly 30 achieves a simplified structure.

After the power button assembly 30 is assembled, the push button 33 is received in the assembly hole 41 of the housing 40, and the support base 32 is fixed to the housing 40 by adhesive flowing into the receiving cavity through the through slots 3213, whereby power button assembly 30 is simply adhered to the housing 40. No dedicated hardware or manpower are required to assemble the power button assembly 30 in proximity to assembly of the electronic device 100, and assembly 30 can correspondingly be assembled elsewhere.

In alternative exemplary embodiments, the guiding element 3223 is formed on the push button 33, and the guiding groove 3321 is formed on the support base 32.

It is believed that the present exemplary embodiments and their advantages will be understood from the foregoing description, and it will be apparent that various changes may be made thereto without departing from the spirit and scope of the exemplary embodiments or sacrificing all of its material advantages.

What is claimed is:

1. A power button assembly, comprising:

a printed circuit board comprising a plurality of terminals and a dome for trigging the terminals;

a support base fixed on the printed circuit board, the support base comprising a base plate defining a through hole and a sleeve integrally formed on the base plate; and a push button positioned between the printed circuit board and the support base, the push button movable along a first axis relative to the support base, wherein one of the push button and the support base comprises a guiding groove, and the other comprises a guiding element slidably received in the guiding groove, the push button comprises a contact portion integrally formed thereon, and the contact portion resiliently abuts the dome and the push button further comprises a cap and a connection portion extending from the outer edge of the cap and sleeved in the sleeve.

2. The power button assembly of claim 1, wherein the guiding element is formed on an inner circumferential surface of the sleeve, and the guiding groove is defined on an outer circumferential surface of the connection portion.

3. The power button assembly of claim 1, wherein at least one locking portion is formed on a surface of the base plate opposite to the sleeve.

4. The power button assembly of claim 1, wherein a plurality of through slots is defined on the base plate around the sleeve.

5. The power button assembly of claim 1, wherein a plurality of posts is formed on an end surface of the sleeve away from the base plate, and the printed circuit board defines a plurality of through holes for engaging the posts, respectively.

6. The power button assembly of claim 5, wherein each post is fixed to one corresponding through hole on the printed circuit board by hot-melting connection.

7. An electronic device comprising:

a housing defining an assembly hole therein;

a power button assembly, comprising:

a printed circuit board comprising a plurality of terminals and a dome for triggering the terminals;

a support base fixed on the printed circuit board; and a push button positioned between the printed circuit board and the support base, movable along a first axis relative to the support base and extending into the assembly hole, wherein one of the push button and the support base comprises a guiding groove, and the other comprises a guiding element slidably received in the guiding groove.

8. The electronic device of claim 7, wherein the push button comprises a contact portion integrally formed thereon, and the contact portion abuts the dome.

9. The electronic device of claim 8, wherein the support base comprises a base plate defining a through hole and a sleeve integrally formed on the base plate, and the push button further comprises a cap received in the through hole and a connection portion extending from an outer edge of the cap and sleeved in the sleeve.

10. The electronic device of claim 9, wherein the guiding element is formed on an inner surface of the sleeve, and the groove is defined on an outer circumferential surface of the connection portion.

11. The electronic device of claim 9, wherein at least one locking portion is formed on the surface of the base plate opposite to the sleeve, and at least one corresponding locking hole is defined in the housing for receiving the locking portion.

12. The electronic device of claim 9, wherein a plurality of through slots are defined on the base plate around the sleeve, and a plurality of corresponding blind slots are defined on the housing, each blind slot and a corresponding through slot cooperatively define a receiving cavity.

13. The electronic device of claim 9, wherein a plurality of posts is formed on a side surface of the sleeve away from the base plate, and the printed circuit board defines a plurality of through holes receiving the posts, respectively.

14. The electronic device of claim 13, wherein each post is fixed in one corresponding assembly hole on the printed circuit board by hot-melting connection.

* * * * *